US009648950B2

(12) United States Patent
Albrecht

(10) Patent No.: US 9,648,950 B2
(45) Date of Patent: May 16, 2017

(54) DEVICE FOR MOVING A MOVABLE FURNITURE PART IN AN OPENING DIRECTION IN RELATION TO A BASIC FURNITURE STRUCTURE OF AN ITEM OF FURNITURE

(71) Applicant: Grass GmbH, Hoechst (AT)

(72) Inventor: Markus Albrecht, Lustenau (AT)

(73) Assignee: Grass GmbH, Hoechst (AT)

( * ) Notice: Subject to any disclaimer, the term of this patent is extended or adjusted under 35 U.S.C. 154(b) by 0 days.

(21) Appl. No.: 15/238,998

(22) Filed: Aug. 17, 2016

(65) Prior Publication Data

US 2017/0049233 A1 Feb. 23, 2017

(30) Foreign Application Priority Data

Aug. 21, 2015 (DE) ..... 20 2015 104 437 U

(51) Int. Cl.

| | |
|---|---|
| ***A47B 95/00*** | (2006.01) |
| ***A47B 88/04*** | (2006.01) |
| ***E05F 15/00*** | (2015.01) |

(52) U.S. Cl.

CPC ..... *A47B 88/0477* (2013.01); *E05F 15/00* (2013.01)

(58) Field of Classification Search

CPC ..... E05F 15/00; E05F 15/16; E05Y 2900/20; A47B 88/0477; A47B 88/16; E05B 63/22

See application file for complete search history.

(56) References Cited

U.S. PATENT DOCUMENTS

2006/0017358 A1* 1/2006 Sato ..... A47B 88/047 312/333
2006/0017359 A1* 1/2006 Sato ..... A47B 88/0477 312/333

(Continued)

FOREIGN PATENT DOCUMENTS

AU 2010280717 B2 7/2015
DE 20 2006 006 182 U1 8/2007

(Continued)

OTHER PUBLICATIONS

German Search Report (Application No. 20 2015 104 437.2) dated Jun. 3, 2016.

(Continued)

*Primary Examiner* — Hanh V Tran
(74) *Attorney, Agent, or Firm* — Burr & Brown, PLLC

(57) ABSTRACT

A device for moving a movable furniture part, the device including a force accumulator such that by way of the device which is fitted to an item of furniture the movable furniture part in the case of an opening procedure under the action of the force accumulator is capable of being put in the opening direction, wherein in the case of a movement of the movable furniture part in the closing direction a charging procedure of the force accumulator is performed, and wherein the force accumulator by way of a coupling installation couples to an ejector so as to eject the movable furniture part. The coupling installation includes a lever assembly designed in such a manner that a force for the charging procedure of the force accumulator, which is introduced at the ejector, by means of the lever assembly is transmitted in a geared manner to the force accumulator.

12 Claims, 9 Drawing Sheets

(56) References Cited

U.S. PATENT DOCUMENTS

| | | | | |
|---|---|---|---|---|
| 2008/0191592 | A1* | 8/2008 | Dubach | A47B 88/0477 312/319.1 |
| 2010/0026152 | A1* | 2/2010 | Huang | A47B 88/0477 312/319.1 |
| 2010/0320888 | A1* | 12/2010 | Koenig | A47B 88/0477 312/333 |
| 2011/0129172 | A1* | 6/2011 | Liang | A47B 88/0422 384/22 |
| 2014/0210329 | A1* | 7/2014 | Brunnmayr | A47B 88/0477 312/333 |
| 2015/0374125 | A1* | 12/2015 | Goetz | A47B 88/0481 312/319.1 |
| 2016/0007750 | A1* | 1/2016 | Goetz | A47B 88/0481 312/319.1 |

FOREIGN PATENT DOCUMENTS

| | | | |
|---|---|---|---|
| DE | 10 2010 036 902 | A1 | 2/2011 |
| DE | 20 2010 009 796 | U1 | 11/2011 |
| DE | 20 2010 013 186 | U1 | 5/2012 |
| DE | 20 2012 003 537 | U1 | 7/2013 |

OTHER PUBLICATIONS

Extended European Search Report (Application No. 16183508.7) dated Dec. 16, 2016.

* cited by examiner

DEVICE FOR MOVING A MOVABLE FURNITURE PART IN AN OPENING DIRECTION IN RELATION TO A BASIC FURNITURE STRUCTURE OF AN ITEM OF FURNITURE

This application claims the benefit under 35 USC §119(a)-(d) of German Application No. 20 2015 104 437.2 filed Aug. 21, 2015, the entirety of which is incorporated herein by reference.

FIELD OF THE INVENTION

The present invention relates to a device for moving a movable furniture part in an opening direction in relation to a basic furniture structure of an item of furniture, and an item of furniture having such a device.

BACKGROUND OF THE INVENTION

In the case of furniture parts such as, for example, drawers, furniture doors, or furniture flaps which are movably received on a basic furniture structure of an item of furniture, guide units, hinges, and fittings are employed for influencing the movement of the respective furniture part.

An additional function for influencing the movement of the furniture part is provided in some embodiments of the respective device. This relates to systems having an opening function of the furniture part by way of a force accumulator, and having a charging function of the force accumulator when closing the furniture part, for example.

SUMMARY OF THE INVENTION

The present invention is based on the object of providing a device of the type referred to at the outset which has an improved charging function.

The present invention proceeds from a device for moving a movable furniture part in an opening direction in relation to a basic furniture structure of an item of furniture, wherein the movable furniture part by way of guide means is capable of being put in the opening direction and in a closing direction that is counter to the opening direction. The device has a force accumulator such that by way of the device which is fitted to the item of furniture the movable furniture part in the case of an opening procedure under the action of the force accumulator is capable of being put in the opening direction, wherein in the case of a movement of the movable furniture part in the closing direction a charging procedure of the force accumulator is performed, and wherein the force accumulator by way of a coupling installation couples to an ejector so as to eject the movable furniture part.

Preferably, the movable furniture part is configured as a drawer or a flap, and the drawer or flap on the basic furniture structure is movably guided on the basic furniture structure by way of guide means, for example, pull-out rails or flap fittings, respectively.

Advantageously, the device is disposed on the movable furniture part, in particular, on a lower side of a drawer base; however, the device may also be fitted to guide means of the item of furniture and/or to the basic furniture structure.

In particular, in the case of an opening and/or closing procedure, the ejector of the device interacts with an entrainment element of the item of furniture and/or of the guide means of the furniture part and/or of the basic furniture structure.

If and when the device is disposed on the movable furniture part, the entrainment element is configured on the guide means of the item of furniture and/or on the basic furniture structure, advantageously in a positionally fixed manner in relation to the basic furniture structure. If and when the device is disposed advantageously in a positionally fixed manner in relation to the basic furniture structure on the guide means of the item of furniture and/or on the basic furniture structure, the entrainment element is configured on the movable furniture part.

The coupling installation may be configured from metal and/or steel and/or sheet-metal and/or wood and/or glass and/or plastics, or from a combination of the materials.

The essential aspect of the present invention is now to be seen in that the coupling installation comprises a lever assembly, wherein the lever assembly is designed in such a manner that a force for the charging procedure of the force accumulator, which is introduced at the ejector, by means of the lever assembly is transmitted in a geared manner to the force accumulator.

Preferably, the lever assembly is designed in such a manner that the latter transmits the force that is introduced into the ejector in an amplified manner, in the sense of a reduction gear, to the force accumulator.

For example, the force is applied by a user from the outside on the drawer, for example, by an impact, and in a closing movement of the movable furniture part is transmitted to the ejector. Charging of the force accumulator then takes place by way of the ejector and the lever assembly during the closing movement of the movable furniture part.

For example, a first coupling member of the lever assembly is advantageously configured as a lever element.

Preferably, a transmission of force and/or movement of the ejector by way of the lever assembly to the force accumulator is possible by way of the design of the first coupling member as a rigid lever element. By way of the design of a first coupling member as a lever element it is moreover possible for the force accumulator to be charged with a comparatively low effort of force, as opposed to the effort of force required for direct charging of the force accumulator.

Advantageously, the first coupling member by way of the second end thereof is mounted so as to be, in particular, freely movable on the ejector, for example, disposed so as to be rotatable and/or displaceable.

In one advantageous variant, a gate-type guide is configured on the ejector, and the first coupling member by way of the second end thereof is configured to be movable on the gate-type guide of the ejector.

Moreover, it is advantageous that the lever assembly is designed in such a manner that the motion element is capable of being charged by a closing procedure of the movable furniture part, wherein the charging procedure of the force accumulator in relation to the coupling installation is performed exclusively by a movement of the ejector by way of the lever assembly.

Preferably, the ejector and the force accumulator during the opening procedure of the movable furniture part and/or during the discharging procedure of the force accumulator are not coupled by way of the lever assembly of the coupling installation.

Advantageously, the lever assembly of the coupling installation comprises two, in particular, three, coupling members.

Advantageously, a coupling member may be manufactured in a comparatively cost-effective manner from a sheet-metal panel, for example, as a stamped part. In particular, a coupling member may be manufactured in a comparatively cost-effective manner as an injection-molded plastics part.

It is also of advantage that the device comprises a motion element, wherein the coupling installation and the ejector are mutually adapted in such a manner that during the opening procedure of the movable furniture part it is the motion element that exclusively and directly transmits a movement of the force accumulator to the ejector.

In one preferred design of the present invention, the ejector and the force accumulator are not directly coupled by way of the motion element during the closing procedure of the movable furniture part.

For example, a retaining member is disposed and/or configured on the motion element. The retaining member may be provided for keeping the force accumulator in the discharged state under a bias on the device.

Optionally, the retaining member of the motion element in the partially discharged state of the force accumulator impacts on a retaining element of the force accumulator and/or of the device, for example, on a base plate of a housing of the device. On account thereof, the force accumulator in a partially discharged state is advantageously kept under a bias.

In one advantageous variant of the present invention, the lever assembly is designed in such a manner that a starting position of the movement of the ejector for the charging procedure of the force accumulator in the case of the movable furniture part being closed is variable by modifying the dimension of a single coupling member.

Advantageously, a lever length of a coupling member of the lever assembly is variable. The lever length of a coupling member, for example, of a lever element, may predefine a starting position of the movement of the ejector for the charging procedure of the force accumulator.

It is also of advantage that a size of the movement range of the ejector in the case of the charging procedure of the force accumulator is predefinable by the design of the lever assembly.

Advantageously, a size of the movement range of the ejector in the case of the charging procedure of the force accumulator is variable by modifying a lever length of a coupling member of the lever assembly.

It is further proposed that the ejector comprises a latch element, and the latch element during the charging procedure of the force accumulator couples the ejector to the coupling installation.

Preferably, the ejector during the charging procedure of the force accumulator is coupled to the coupling installation, in particular, to a coupling member of the lever assembly, exclusively by way of a latch element.

Moreover, it is favorable for the force accumulator during the charging procedure to couple to the ejector exclusively by way of the lever assembly of the coupling installation.

The ejector is favorably arrested in a standby position when the coupling installation is coupled to the ejector by way of a latch element.

The coupling of an entrainment element of the movable furniture part and/or of the guide means of the furniture part and/or of the basic furniture structure to the ejector may be released in the standby position of the ejector.

Moreover, the standby position of the ejector may be configured as a starting position of the ejector for the charging procedure of the force accumulator.

It is moreover of advantage that a second coupling member is movably disposed on a first coupling member.

The first coupling member and the second coupling member are advantageously intercoupled in a rotatable manner.

In one advantageous embodiment, the second coupling member by way of the first end thereof is movably disposed on a first articulation point on a central region of the first coupling member.

In one advantageous design embodiment, the second coupling member is configured so as to be flexible.

The second coupling member is configured as a rope or wire, for example.

In one moreover advantageous design embodiment of the present invention, the second coupling member of the lever assembly by way of a first end is disposed so as to be movable on the first coupling member and by way of a second end so as to be movable on the force accumulator, in particular, on the motion element of the force accumulator.

The second coupling member may be configured in such a manner that the former may transmit tensile forces, in particular, exclusively tensile forces, which by virtue of the first coupling member and/or of the force accumulator act on the second coupling member.

Preferably, the base plate of the housing of the device comprises a gate-type guide.

The second end of the second coupling member is disposed so as to be movable on the base plate of the device, for example.

Advantageously, the second coupling member by way of the second end thereof, and/or the motion element on which the second coupling member is disposed, may be disposed so as to be displaceable on the gate-type guide of the base plate.

The gate-type guide may be designed in such a manner that the second end of the second coupling member, and/or the motion element in the case of charging and/or discharging of the force accumulator are/is advantageously movable parallel with the opening and/or closing direction of the movable furniture part.

The motion element is preferably configured as a slide and is guided in the gate-type guide on the base plate.

It is moreover of advantage that the lever assembly has a third coupling member, and the third coupling member is movably disposed on the first coupling member.

The third coupling member is advantageously disposed so as to be rotatable on the first coupling member.

It is also of advantage that the third coupling member by way of a first end is disposed so as to be movable on the second end of the first coupling member and by way of a second end so as to be movable on the ejector.

For example, the third coupling member by way of a first end is disposed so as to be movable on a third articulation point on the second end of the first coupling member and by way of a second end so as to be movable on a fourth articulation point on the ejector.

It is also advantageous that the third coupling member is configured as a lever; for example, the third coupling member is configured to be rigid, in particular, as a rigid tension lever.

Advantageously, the third coupling member is designed in such a manner that the former may transmit compressive forces, in particular, exclusively compressive forces, which by virtue of a movement of the ejector and/or of a closing movement of the movable furniture part act on the third coupling member, advantageously to the first coupling member, in particular, to the force accumulator.

The first coupling member may be disposed so as to be movable on the base plate of the housing and/or on a cover component of the housing.

For example, the first coupling member is disposed on a fifth articulation point on the base plate and/or on the cover component.

The cover component may be provided in order to cover the base plate of the device across a substantial region, that is to say, across more than 50% of the area of the base plate.

The fifth articulation point may be configured as a center of rotation of the lever assembly. The first and/or the second and/or the third coupling member may have a motion component about the center of rotation in the case of an opening and/or closing procedure of the movable furniture part, in particular, in the case of a movement of the ejector and/or of the force accumulator.

Advantageously, the first and/or the third articulation point move on a circular path about the center of rotation. In particular, the third articulation point is disposed on the first coupling member in such a manner that the radius of the circular path of the third articulation point is larger than the radius of the circular path of the first articulation point.

Advantageously, the second articulation point and the articulation point of the third coupling member on the ejector move parallel with an opening and/or closing direction of the movable furniture part.

Advantageously, the connecting line through the fifth articulation point and the third articulation point in relation to the connecting line through the fifth articulation point and the first articulation point in the movement plane of the coupling installation has an angle which does not equal zero.

It is moreover of advantage that the third coupling member is disposed so as to be movably guided on the gate-type guide of the ejector.

For example, the third coupling member by way of the second end thereof is disposed on the gate-type guide in such a manner that the second end of the third coupling member in the case of a movement of the force accumulator, in particular, in the case of the force accumulator being discharged, is guided by the gate-type guide.

Advantageously, the base plate of the device has a second gate-type guide, and the third coupling member by way of the second end thereof is disposed so as to be displaceable on the second gate-type guide. The second gate-type guide may be designed in such a manner that the second end of the third coupling member in the case of charging and/or discharging of the force accumulator is advantageously movable parallel with the opening and/or closing direction of the movable furniture part.

Advantageously, the third coupling member along a longitudinal axis is comparatively longer than the second coupling member.

Advantageously, the spacing between the third articulation point and the fourth articulation point of the third coupling member is comparatively larger than the spacing between the first articulation point and the second articulation point of the second coupling member.

Advantageously, a locking element is disposed and/or configured on the first coupling member.

The locking element may be provided for keeping the charged force accumulator in the charged state thereof by way of the coupling installation.

In one advantageous variant of the device, a stop element is disposed and/or configured on the first coupling member. The stop element may be designed in such a manner that the force accumulator following the discharging procedure thereof by the coupling installation is held in a partially discharged state under a bias.

Advantageously, the stop element is designed in such a manner that a noise which is disturbing to a user of the device, for example, a clicking noise in the case of the first coupling member impacting on a stop member of the device, is reduced or is not created.

The stop element may be designed as an elastic element, for example, as a spring element, and/or from an elastic rubber. The stop element may act in a sprung and/or damping manner.

BRIEF DESCRIPTION OF THE DRAWINGS

Further features and advantages of the present invention are explained in more detail by means of exemplary embodiments which are schematically illustrated in the figures.

DETAILED DESCRIPTION OF THE INVENTION

Figure 1:
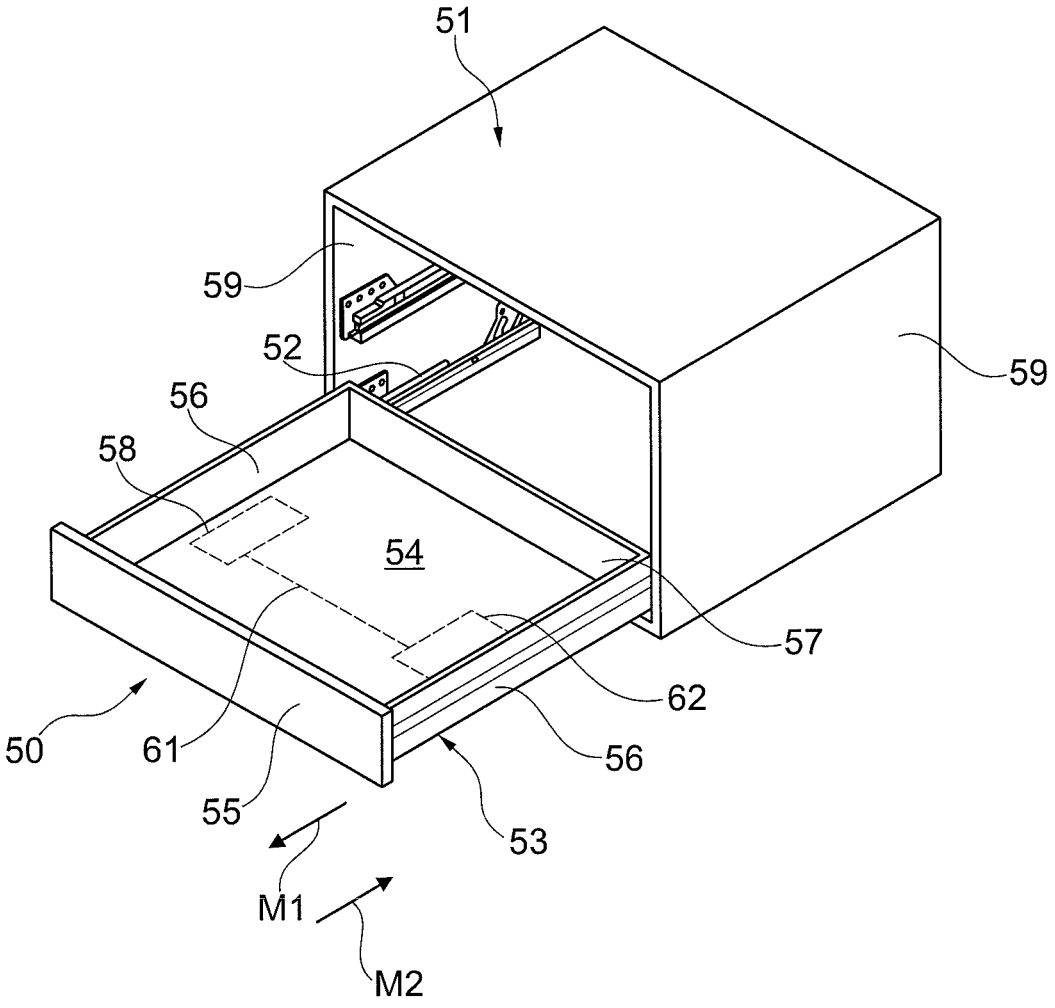
FIG. 1 shows an item of furniture according to the present invention in a perspective view from obliquely above, having a drawer in a completely opened state on a basic furniture structure.

An item of furniture 50 according to the present invention, having a box-shaped basic furniture structure 51 and a drawer 53 which by way of guide means 52 is movably guided, is illustrated in FIG. 1. The drawer 53 comprises a drawer base 54, a drawer front 55, side walls 56, and a rear drawer wall 57. Two guide means 52 with identical action for guiding the drawer 53 are present in each case between each side wall 56 of the drawer 53 and an associated basic-structure side wall 59. A device 58 according to the present invention (illustrated with dashed lines), for moving or ejecting, respectively, the furniture part which is configured as a drawer 53 in the opening direction M1 is disposed on a lower side of the drawer base 54.

Figure 2:
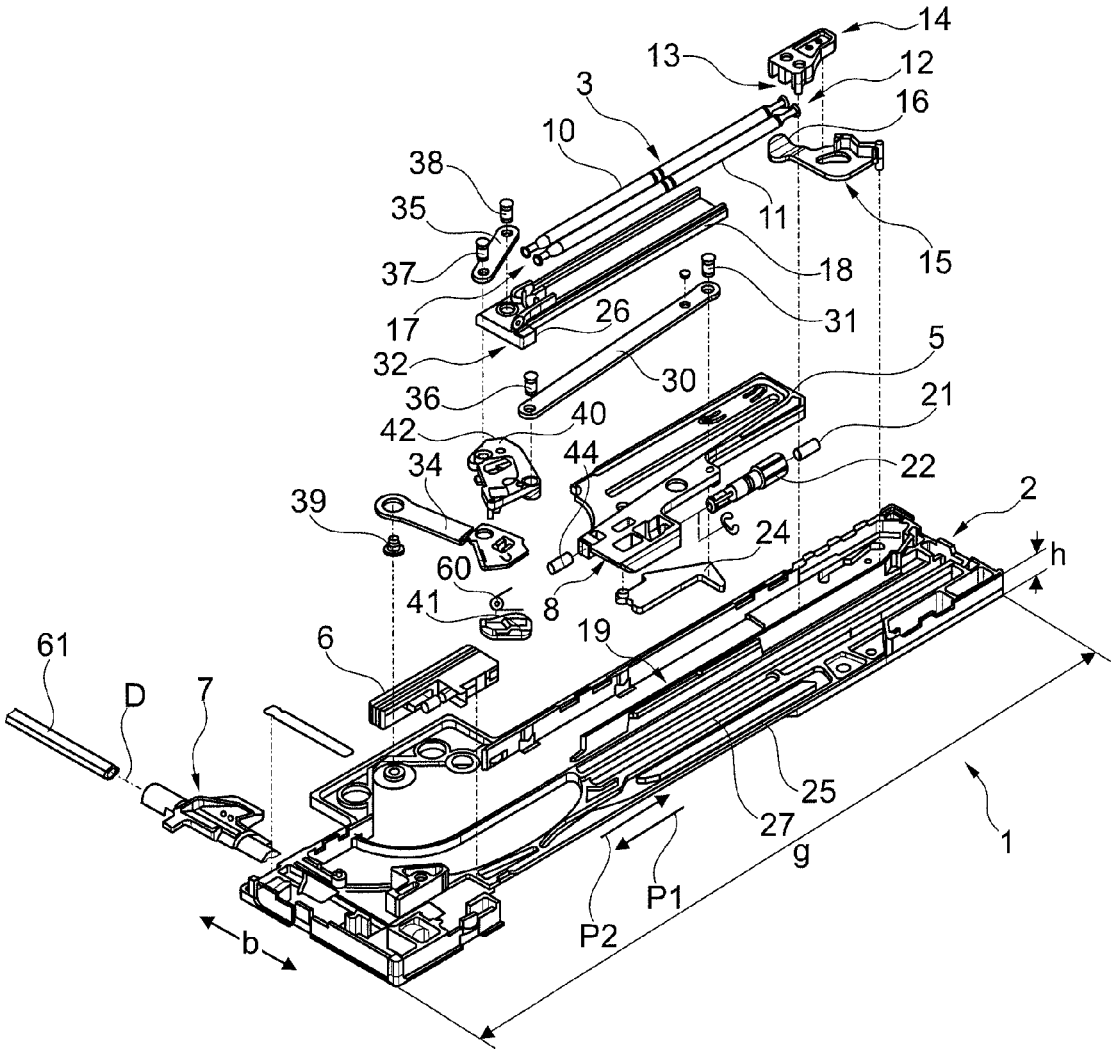
FIG. 2 shows a device according to the present invention, without a cover component, in an exploded illustration.

FIG. 2 shows the exploded illustration of the device 58 which is configured as an ejector unit 1 for the drawer 53.

The ejector unit 1 serves for the force-assisted ejection of the drawer 53 across a first part-distance of the opening movement of the drawer 53 in relation to the basic furniture structure 51, from a closed position in the opening direction M1 of the drawer 53.

The drawer 53 by way of the guide means 52, for example, two identical part-pullout units or full-pullout units, is mounted on the basic furniture structure 51 so as to be displaceable in the directions M1 and M2.

Alternatively, the ejector unit 1 may be disposed on the basic furniture structure 51 or on the guide means 52 of the item of furniture 50.

The ejector unit 1 comprises inter alia a base plate 2, a force accumulator 3, a coupling installation 4, an ejector 5, an activator 6, and a locking member 7.

Figure 9:
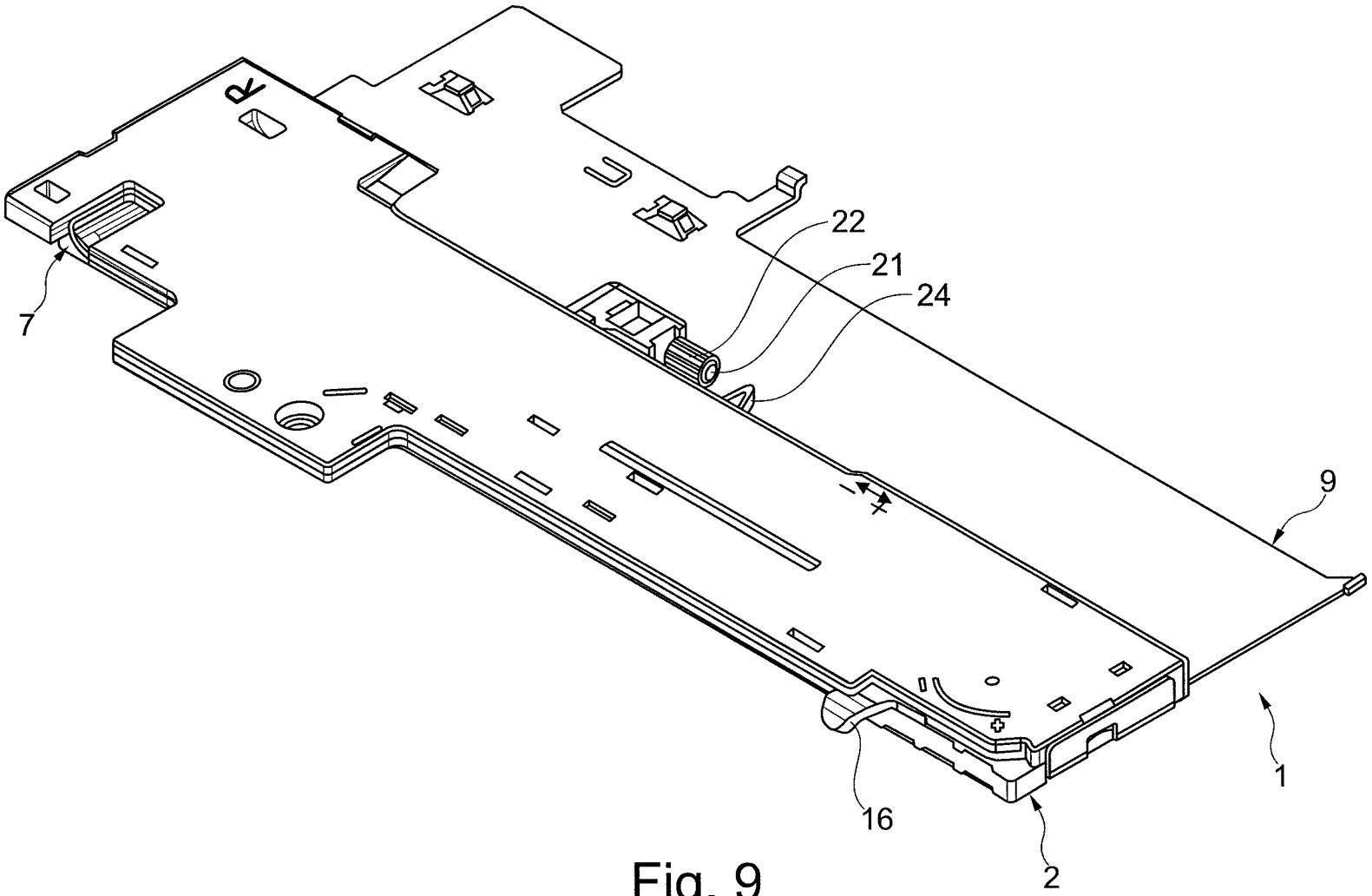
FIG. 9 shows the device according to FIG. 5, having the cover component, in a perspective view from obliquely below toward a second main side of the device.

A housing of the ejector unit 1 comprises the base plate 2 and a cover component 9 which is visible in FIG. 9. The ejector unit 1 may be disposed on the lower side of the drawer base 54 and/or on the guide means 52 by way of the housing or by way of the cover component 9 and/or the base plate 2, respectively.

Retaining portions, guide contours, stop members, and/or receptacle portions for linking the individual components of the ejector unit 1 are configured on the base plate 2. The base plate 2 is designed substantially as a rectangular, elongate or strip-shaped component, having a comparatively minor height h of approx. 5 to 15 millimeters, for example. The base plate 2 furthermore has a width b of approx. 4 to 10 centimeters, and a length g.

According to the exemplary embodiment shown, the force accumulator 3 comprises two identical coil springs 10, 11 which configure a spring pack and which are disposed in parallel. At a first end 12 of the force accumulator 3, the coil springs 10, 11 are disposed on an adjustable fixed mounting 13. The fixed mounting 13 comprises a movable mounting part 14 on which the coil springs 10, 11 are received in a releasable yet fixed manner, and a set part 15 having an operating portion 16 by way of which a user may adjust from the outside a position of the end 12 of the force accumulator 3 in a modifiable and positionally fixed manner. On account thereof, an effect of force of the force accumulator 3 on the drawer 53 may advantageously be pre-adjusted in the case of the opening procedure of the drawer 53.

The associated ends of the coil springs 10, 11 are fastened to a slide-type motion element 18 at a second end 17 of the force accumulator 3. The slide-type motion element 18 by way of an associated guide contour 19 is linearly guided on the base plate 2 so as to be movable in a movement direction P1 and in an opposite movement direction P2.

The movement directions P1 and P2 of the motion element 18 (cf. FIGS. 2 and 3) run parallel with the opening direction M1 of the drawer 53 and with a closing direction M2 which is counter thereto.

If and when the ejector unit 1 is disposed in a positionally fixed manner on the basic furniture structure 51 and/or on a stationary part of the guide means 52, the opening direction of the drawer 53 corresponds to the direction P1 on the device, and the closing direction of the drawer 53 corresponds to the direction P2 on the device.

Herebelow, an assembled state of the ejector unit 1 on the drawer base 54 is assumed.

Figure 3:
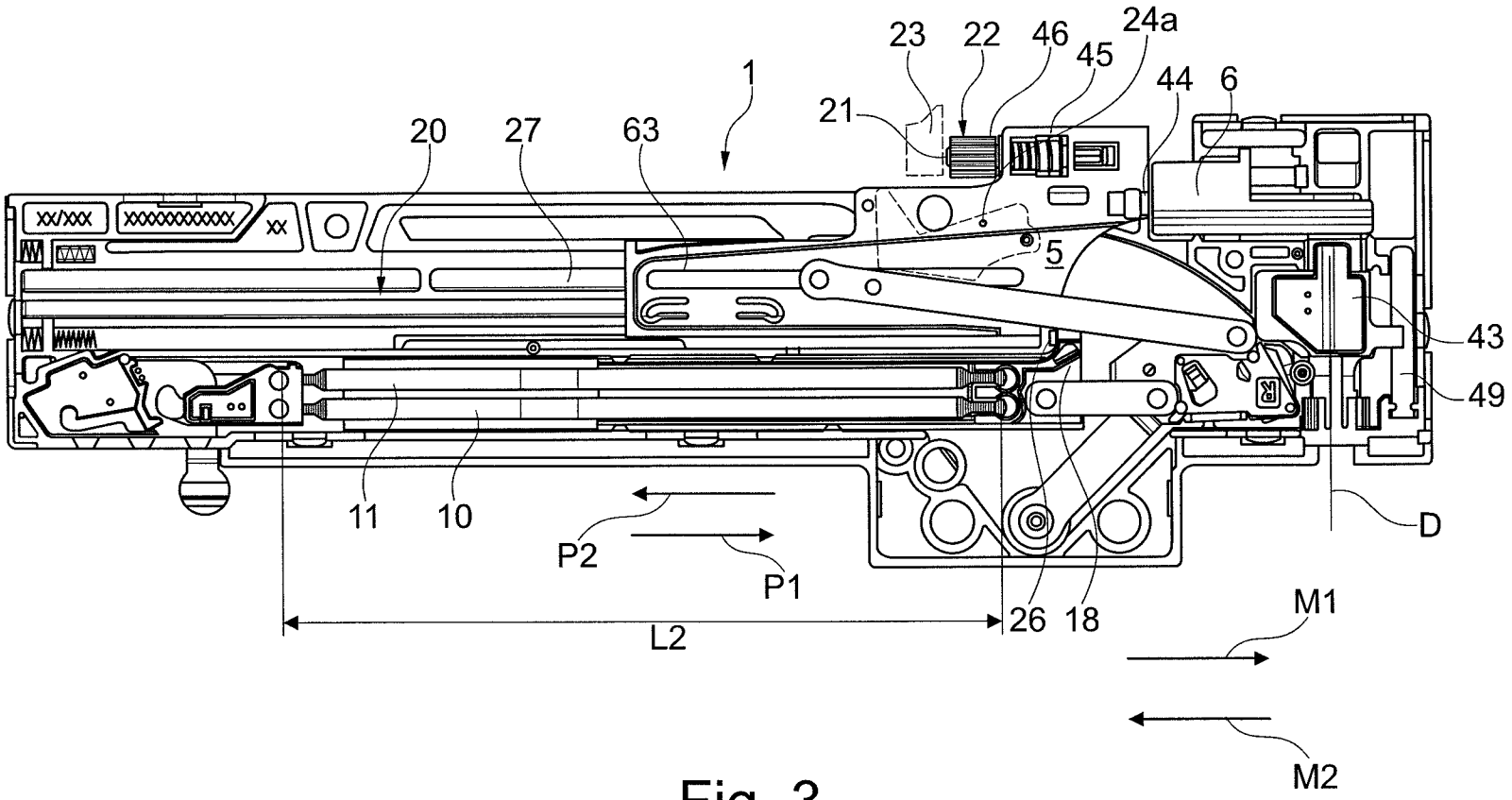
FIGS. 3 to 8 show the device according to FIG. 2, in the assembled state, in a plan view of a first main side, in various operational states.
Figure 7:
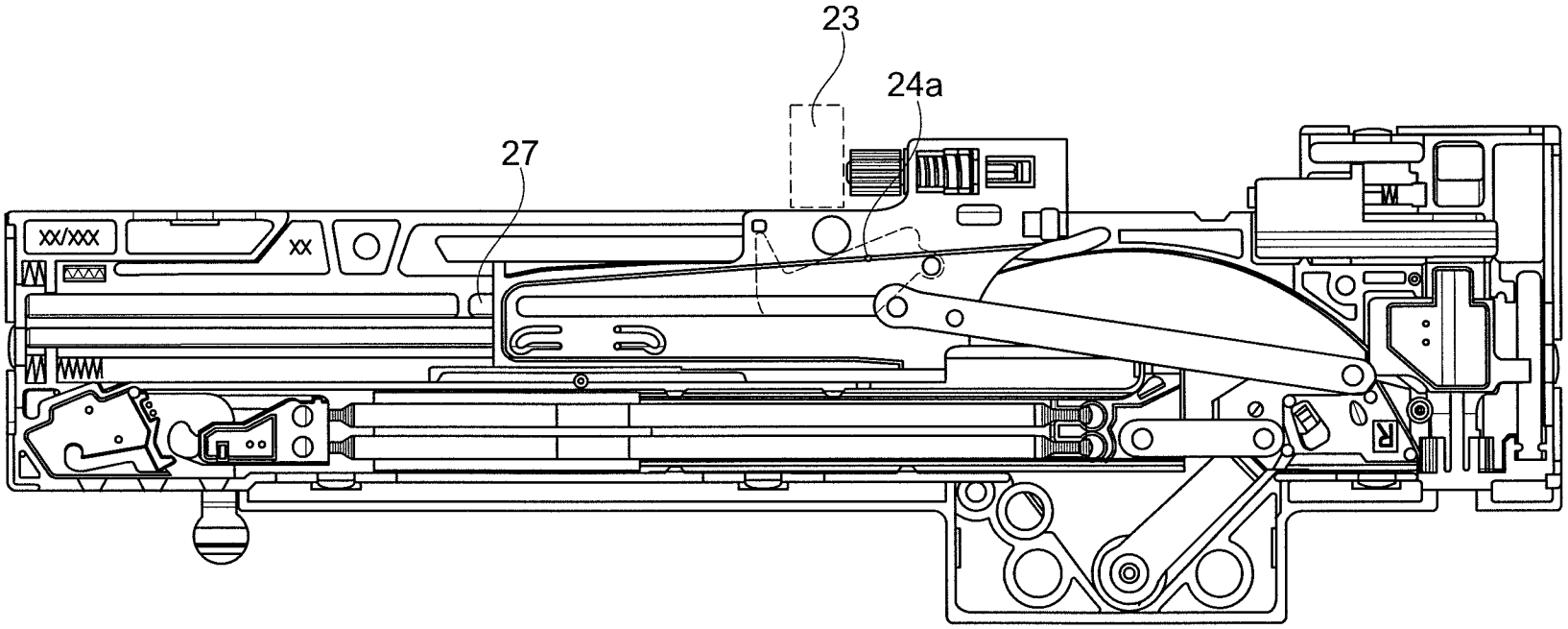
Figure 8:
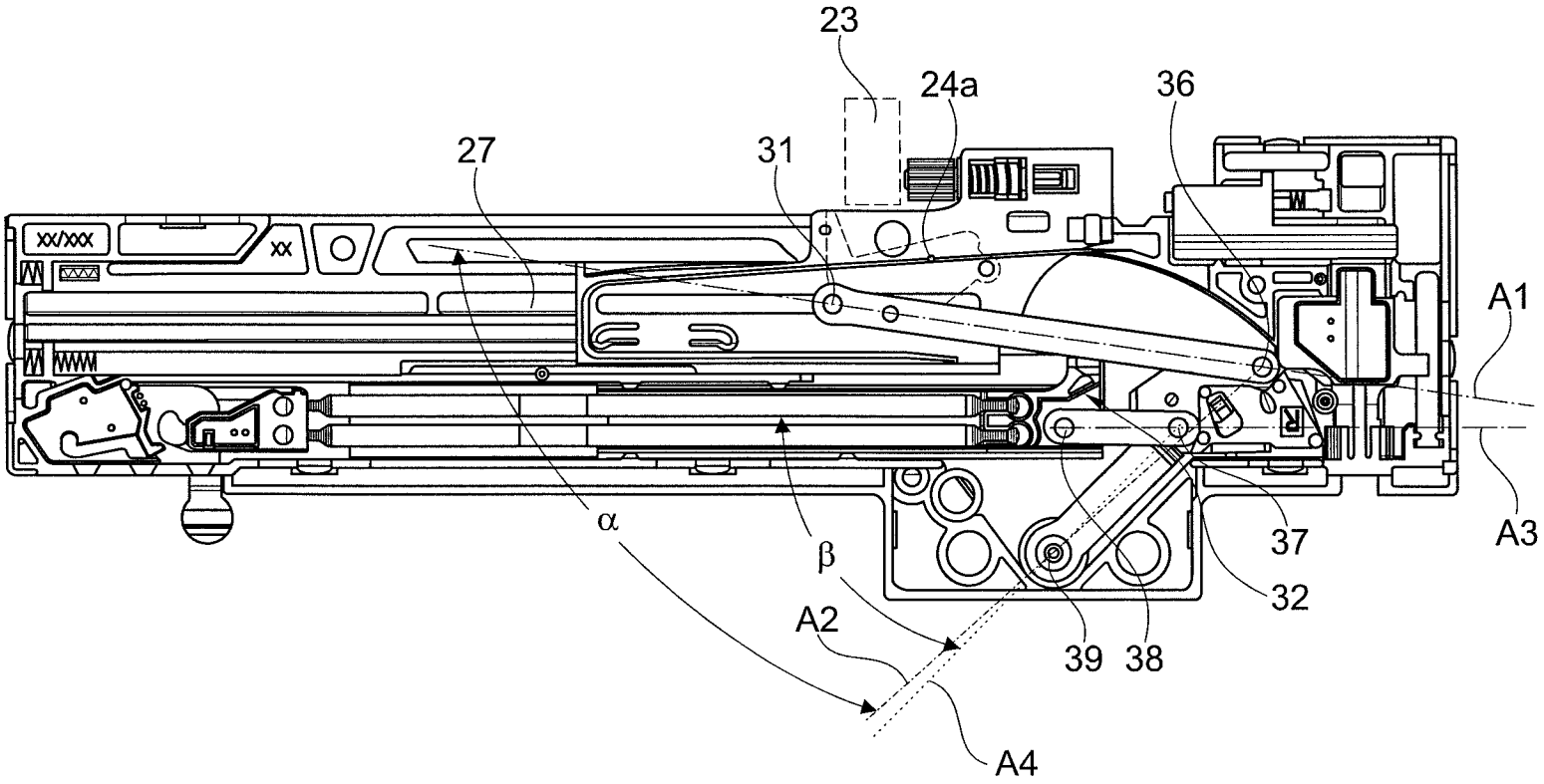

FIGS. 3, 7 and 8 show the ejector unit 1 in a tensioned state of the force accumulator 3, in which the coil springs 10, 11 are elongated or are tensioned so as to be under a tensile load, respectively; herein, motion element 18 in relation to a retracted position in the direction P2 is offset on the base plate 2 in the direction P1 and is retained in a tensioned position.

Figure 5:
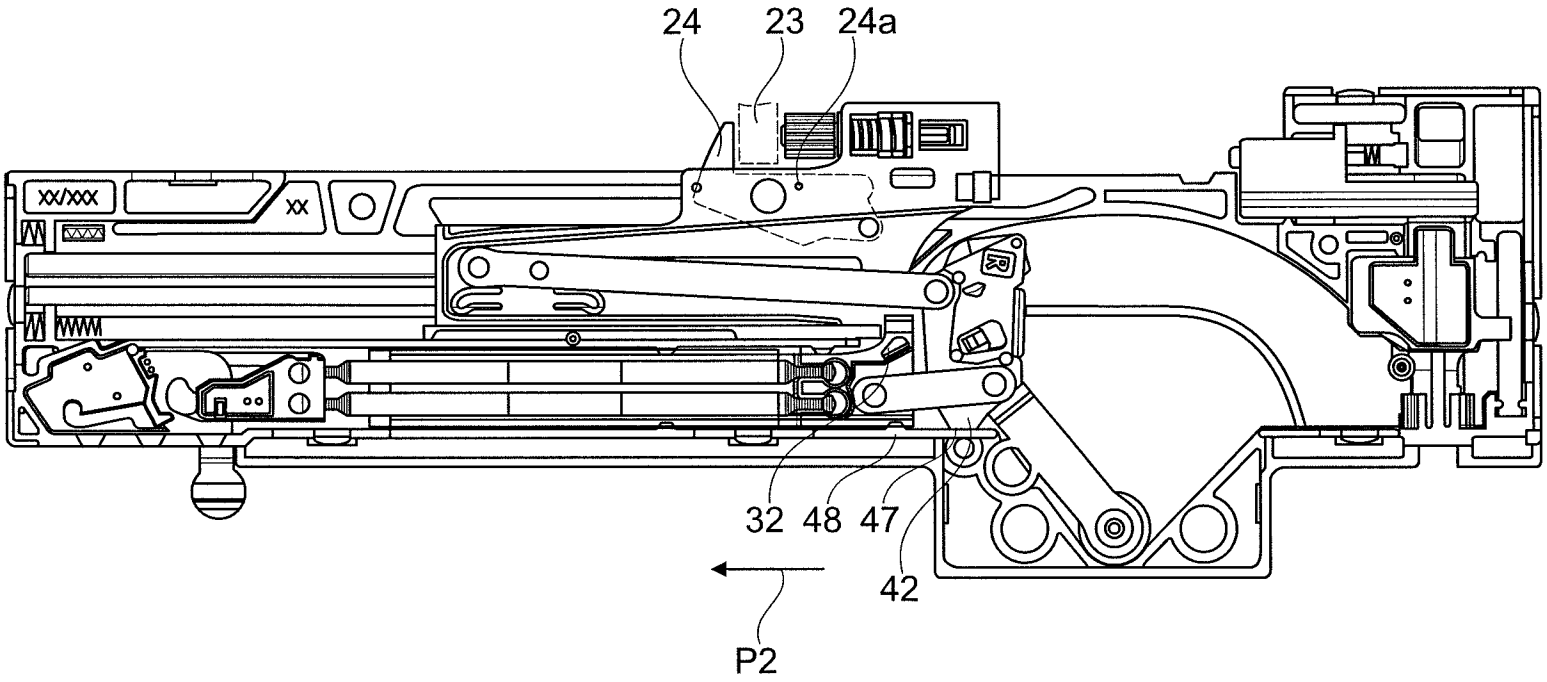
Figure 6:
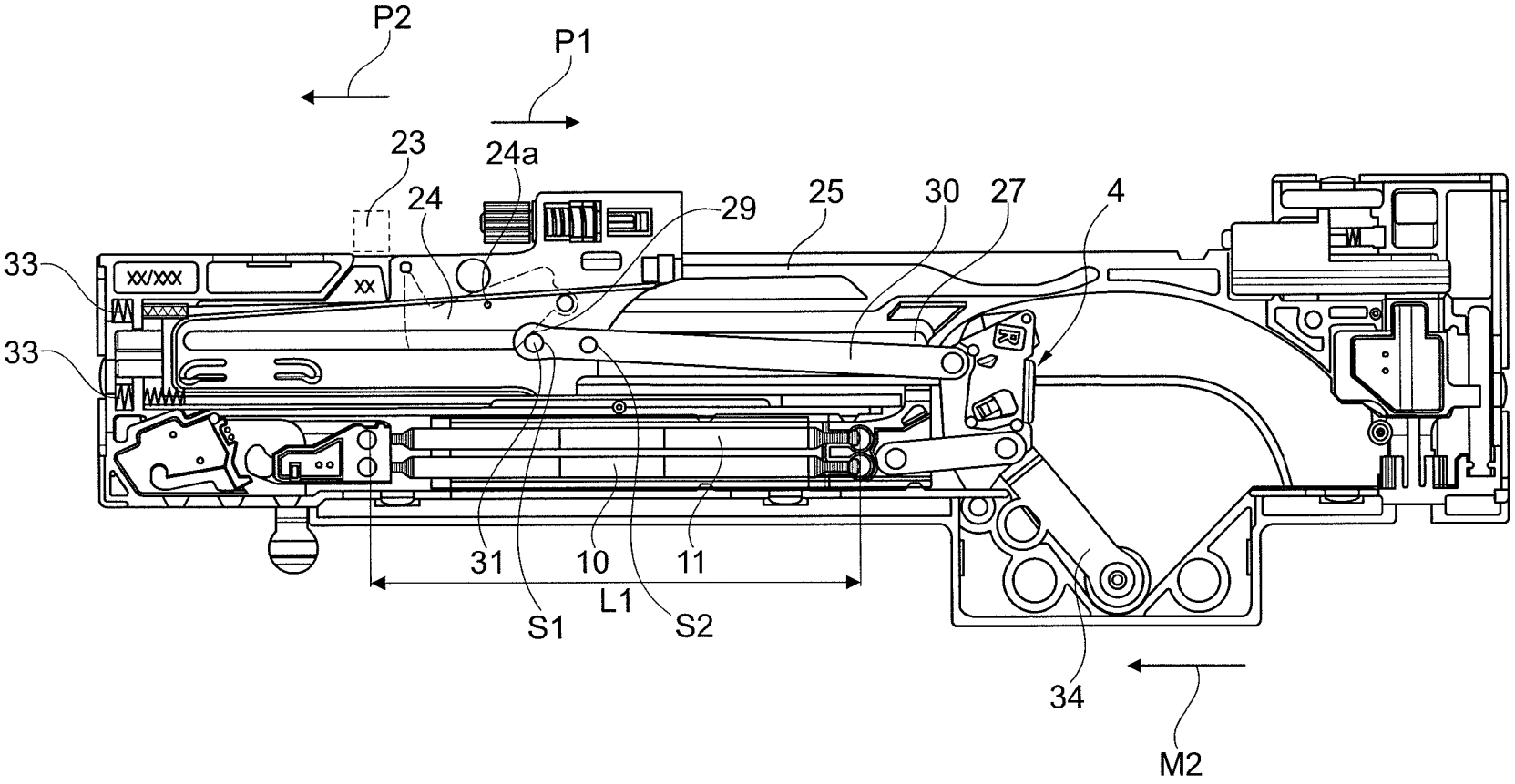

FIGS. 5 and 6 show the ejector unit 1 in a discharged basic state of the force accumulator 3, in which the coil springs 10, 11 are furthermore biased under a tensile load but to a lesser degree, and have a length L1.

In the tensioned state of the force accumulator 3 the coil springs 10, 11 have a length L2 which is greater than L1.

A retaining member 32 having a stop element 26 is present on the motion element 18. The stop element 26 in the case of a force-assisted opening procedure is in contact with an ejector 5.

By way of the coupling installation 4, the force accumulator 3 or the motion element 18, respectively, is operationally connected to the ejector 5, preferably exclusively in the case of the closing procedure of the drawer 53. The ejector 5 is movable to and from in the directions P1 and P2, in particular, exclusively movable in a linear manner, or so as to be parallel with the movement direction of the motion element 18, respectively. To this end, a linear guide 20 which is adapted to guide portions, for example, on one side of the ejector 5, is configured on the base plate 2.

Figure 4:
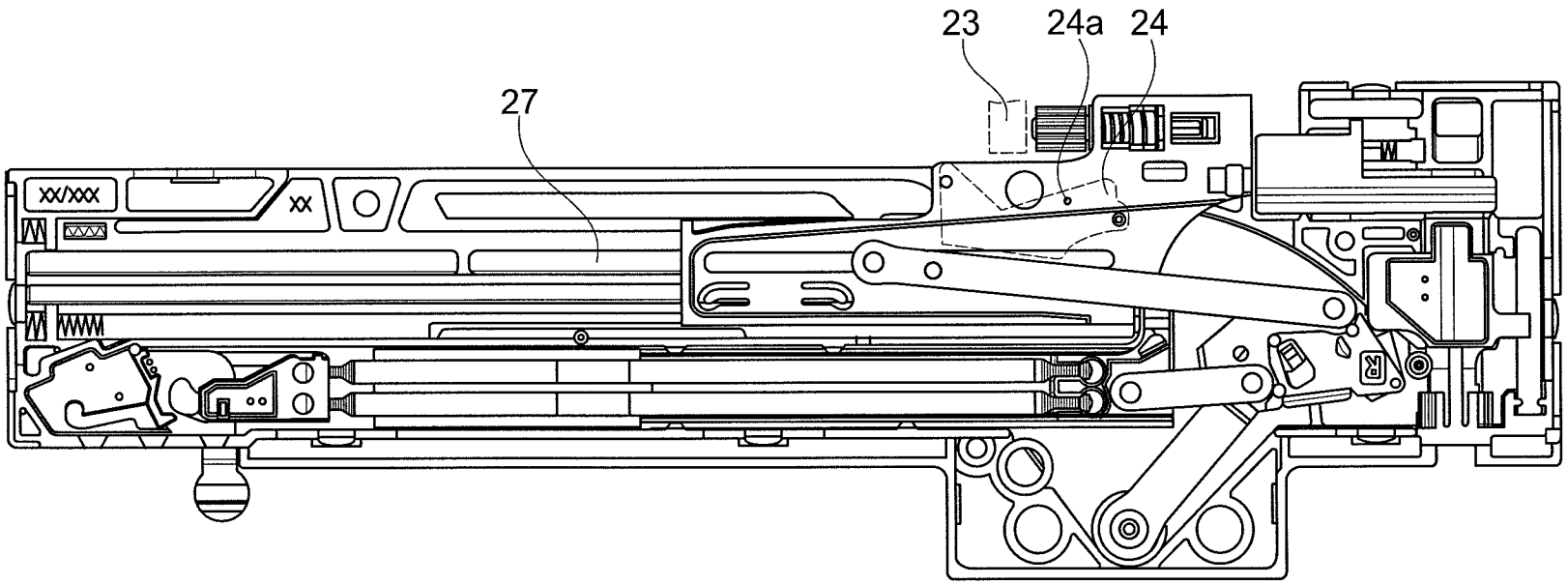

An opening procedure of the drawer 53, caused by the ejector unit 1, takes place exclusively by way of a direct operational connection of the force accumulator 3 to the ejector 5, by way of the motion element 18 which moves in the direction P2. To this end, a stop element 26 which is advantageously designed so as to be elastic and thus prevents or at least dampens any sound which is disturbing to a user when the motion element 18 impacts the ejector 5 in the opening procedure of the drawer 53 is configured on the motion element 18 (FIGS. 3, 4 and 5).

A front-gap adjustment assembly 8 which is configured on the ejector 5 comprises a housing 45 and a set screw 22 having a contact portion 21. The set screw 22 has an external thread which interacts with an internal thread on the housing 45 (cf. FIG. 2). Depending on the rotation direction, a position of the contact portion 21 of the set screw 22 is adjustable in the direction P1 or P2 by manual rotation of an operating portion 46 of the set screw 22 by a user. In particular, the set screw 22 is configured so as to be self-locking in relation to the housing 45. A measure of a front gap between the drawer front 55 of the drawer 53, which is closed on the basic furniture structure 51, and end sides of the basic furniture structure 51 is capable of being predefined by way of the predefined position of the set screw 22.

The contact portion 21 of the set screw 22 in the tensioned or charged state, respectively, of the force accumulator 3 bears on an entrainment element 23 which in respective operational states forms a stop for the contact portion 21. The entrainment element 23 which in FIGS. 3 to 8 is merely indicated by dashed lines may be present on a fixed rail of the guide means 52, for example, or be attached to the basic furniture structure 51 when the ejector unit 1 is disposed on the drawer 53.

However, if and when the ejector unit 1 is disposed on the basic furniture structure 51 or on a positionally fixed part of the guide means 52 of the item of furniture 50, the entrainment element 23 may be present on the drawer 53 and thus be movable in relation to the basic furniture structure 51.

If and when, proceeding from the basic position of the ejector unit 1 according to FIG. 3, a locking feature is cancelled on the ejector unit 1, as is shown in FIG. 4 and will be explained in more detail below, the tensioned or charged force accumulator 3, respectively, pulls the motion element 18 in the direction P2, the latter by way of the stop element 26 urging or sliding, respectively, the ejector 5 in relation to the base plate 2 in the direction P2.

As soon as the ejector 5 on the base plate 2 moves in the direction P2, a latch component 24 of the ejector unit 1, which is pivotably mounted on the ejector 5, is put from an inwardly pivoted position according to FIG. 4, in which the latch component 24 in relation to an external periphery of the base plate 2 is completely retracted, to an outwardly pivoted position in which the latch component 24 by way of a lug partially projects beyond the external periphery of the base plate 2 (FIG. 5), this being implemented by way of a loop-shaped closed guide track 25 in the base plate 2 and by way of a guide pin 24*a*, engaging in the guide track 25, on the latch component 24.

In order for the latch component 24 to be illustrated, the outline thereof which is obscured by other components, in particular, by the ejector 5, in FIGS. 3 to 8 is indicated with dashed lines.

In the basic state which is illustrated in FIG. 5, the force accumulator 3 is located in a terminal position of the discharged state, wherein the force accumulator 3 is unable to move the ejector 5 any farther in the direction P2.

By virtue of the kinetic energy of the drawer 53, caused by the preceding ejection movement, and/or by manually moving the drawer 53 farther in the opening direction M1 by a user, the ejector 5 is subsequently displaced in relation to the base plate 2 in the direction P2. This is thus possible because the latch component 24 which has been outwardly pivoted so as to project from the ejector 5 bears on the entrainment element 23, the ejector 5 in the further course of the movement of the drawer thus reaching the terminal position thereof which is displaced to a maximum in the direction P2 on the base plate 2. By reaching the terminal position on the ejector 5, the latch component 24 is again completely pivoted inwardly, this being predefined by the interaction between the guide track 25 and the guide pin 24*a* engaging therein on the latch component 24.

If and when the drawer 53 following a discharging procedure of the force accumulator 3 is moved farther in the opening direction M1, the ejector unit 1 separates from the entrainment element 23, cancelling contact between the entrainment element 23 and the contact portion 21 of the set screw 22 (FIG. 6).

From the terminal position described above, which the ejector assumes only briefly, the ejector 5 by spring elements 33 on the base plate 2 is urged by a few millimeters in the direction P1, for example. In relation to the coil springs 10, 11 of the force accumulator 3, the spring elements 33 have a comparatively minor force. By way of the movement of the ejector 5 in the direction P1 by way of the force of the spring elements 33, a bearing portion 29 of the latch component 24 in a standby position of the ejector 5 is put in direct clearance-free contact with a mounting pin 31 of a tension lever 30 of the coupling installation 4 (FIG. 6). The mounting pin 31 is disposed on a first end of the tension lever 30 and may move freely along a, for example, linear, guide track 27 and/or a linear guide 63 which is configured on the ejector 5 for so long, and, in particular, within an opening procedure of the drawer 53, until the latch component 24 holds the mounting pin 31 and/or the tension lever 30 in direct, clearance-free contact with the ejector 5.

The standby position of the ejector 5 which is shown in FIG. 6 at the same time is also a starting position of the ejector 5 for a tensioning procedure of the force accumulator 3 by way of the coupling installation 4.

While the mounting pin 31 is disposed at the first end of the tension lever 30 instead of at a point S1 on a point S2, the starting position of the tensioning movement of the ejector may be varied. If and when the mounting pin 31 is disposed at the point S2, the starting position of the ejector is repositioned in the direction P1 in relation to a disposal on the point S1. Moreover, it would be conceivable for the length of the tension lever 30 to be modified, for example, to be shortened. It would also be conceivable for the mounting of the latch component 24 on the ejector 5 to be modified, for example, in the direction P2 on the ejector 5, and thus to modify the position of the clearance-free contact in the tensioning procedure between the ejector 5 and the tension lever 30 in relation to the ejector 5.

Besides the tension lever 30, the coupling installation 4 comprises a guide lever 34 and a connection element 35. By way of a mounting pin 36, the tension lever 30 on a second end is articulated on the guide lever 34. The connection element 35, on a second end, by way of a mounting pin 37 which is spaced apart from the mounting pin 36, is likewise articulated on the guide lever 34, and on the first end thereof, the connection element 35 by way of a further mounting pin 38 is articulated on the motion element 18. The guide lever 34 at a first end by way of a mounting pin 39 is disposed so as to be movable, in particular, pivotable, on the base plate 2. The mounting pin 39 is preferably received both on the base plate 2 as well as on the cover component 9.

A longitudinal axis A1 of the tension lever 30, which runs through the mounting pins 31, 36 of the tension lever 30, in relation to a first longitudinal axis A2 of the guide lever 34, which runs through the mounting pins 36, 39, has an angle $\alpha$.

A longitudinal axis A3 of the connection element 35, which runs through the mounting pins 37, 38 of the connection element 35, in relation to a second longitudinal axis A4 of the guide lever 34, which runs through the mounting pins 37, 39, has an angle 3.

The guide lever 34 of the coupling installation 4, on a second end, comprises a lever attachment 40. A locking element 41 and a stop element 42 are configured on the lever attachment 40.

The terminal position of the discharged state of the force accumulator 3 (FIG. 5) is predefined by a stop of the stop element 42 of the guide lever 34 on a wall portion 47 on a step-type wall 48 of the base plate 2. The wall portion 47 is formed from an annular portion of a damping element, for example. If and when the stop element 42 of the guide lever 34 following a discharging procedure of the force accumulator 3 bears on the wall portion 47, by virtue of a remaining bias of the coil springs 10, 11 a tensile force in the direction P2 is transmitted from the motion element 18 by way of the connection element 35 to the guide lever 34. By virtue of the rigid embodiment of the coupling installation 4, or by virtue of the impact of the stop element 42 on the wall portion 47, respectively, the motion element 18 is prevented from moving farther in the direction P2, wherein the force accumulator 3 by way of the motion element 18 is held free of clearance in the terminal position of the discharged state.

In particular, the stop element 42 and/or the wall portion 47 may be designed so as to be elastic or damping, respectively, thus reducing or preventing an impact noise.

When tensioning the force accumulator 3, the guide lever 34 by virtue of the design thereof may transmit a force from the tension lever 30 to the connection element 35 at a geared up ratio.

The geared up transmission ratio is formed, on the one hand, by the ratio of the spacing of the mounting pins 39 and 36 in relation to the spacing of the mounting pins 39 and 37 on the guide lever 34 and, on the other hand, by the combined mutual circular and linear movement of the tension lever 30 and/or of the connection element 35 during the charging procedure of the force accumulator 4.

The elements of the coupling installation 4, by virtue of the arrangement of the former on the ejector unit 1, may move as follows:

The mounting pin 31 and thus the first end of the tension lever 30, by virtue of the mounting thereof in the guide track 27, may move exclusively parallel with a movement direction of the ejector 5, in particular, parallel with a movement direction of the movable furniture part 53.

The mounting pin 38 and thus the first end of the connection element 35, by virtue of the mounting thereof on the slide-type motion element 18 and thus advantageously in the guide contour 19, may move exclusively parallel with a movement direction of the motion element 18 or of the ejector 5, respectively, in particular, parallel with the movement direction of the movable furniture part 53.

The mounting pin 36 and thus the second end of the tension lever 30, by virtue of the mounting thereof at the second end of the guide lever 34, may move exclusively in a circular path about a rotation center of the mounting pin 39 of the guide lever 34.

The mounting pin 37 of the connection element 35 and thus the second end of the connection element 35, by virtue of the mounting thereof in a central region of the guide lever 34, may move exclusively in a circular path about a rotation center of the mounting pin 39 of the guide lever 34.

By virtue of the above-mentioned design, the coupling installation 4 may transmit at a geared up ratio a force for tensioning the force accumulator 3 from the ejector 5 by way of the tension lever 30 and of the guide lever 34 to the connection element 35 and thus to the force accumulator 3, and, in particular, the coupling installation 4 transmits the force which is exerted by the ejector 5 in a geared down ratio to the force accumulator 3. This means that a user when charging the force accumulator 3 has to apply less force to the ejector 5 than the user would have to apply when wishing to charge the force accumulator 3 without geared down ratio, or when directly pulling the end 17 of the force accumulator 3 in the direction 31, respectively.

The beginning and the end of the charging procedure of the force accumulator 3 or of the coil springs 10, 11, respectively, are visualized in FIGS. 6 and 7.

Tensioning of the force accumulator 3 is performed by a movement of the drawer 53 in the case of closing, or on a part-distance of the closing movement of the drawer 53. The starting position of the ejector unit 1, in which the latter is prepared for tensioning of the force accumulator 3 and expects a closing procedure of the drawer, is shown in FIG. 6.

If and when the drawer 53 is closed, for example, from the outside by a user, the ejector unit 1 moves in the direction M2 toward the entrainment element 23. The charging procedure of the force accumulator 3 begins as the contact portion 21 of the set screw 22 of the ejector 5 impacts on the entrainment element 23. The ejector 5, by impacting on the entrainment element 23, is moved in the direction P1, for example, by virtue of the inertia of the drawer 53 in relation to the base plate 2.

By way of the coupling of the ejector 5 to the force accumulator 3 by way of the coupling installation 4, the motion element 18 of the force accumulator 3 is likewise displaced in relation to the base plate 2 in the direction P1, and the second end 17 of the coil springs 10, 11 is displaced in the direction P1, the coil springs 10, 11 thus being elongated.

At the end of the tensioning procedure of the force accumulator 3, the ejector 5 is located in a terminal charging position, as is shown in FIG. 7. In the tensioned state of the force accumulator 3, the ejector unit 1 is located in a locked state.

In the locked state, a locking state is determined by the locking element 41 of the coupling installation 4 and by the locking member 7 which is configured as a flap, wherein a discharging movement of the coupling installation 4 is blocked by the locking member 7.

Tensioning of the force accumulator 3 is fully completed prior, for example, to an automatic retracting feature for the force-assisted retraction of the drawer 53 into the fully closed closing position on the basic furniture structure 51 becoming effective. The automatic retracting feature is not part of the ejector unit 1, and is integrated, for example, in the guide means 52 or in the part-pullout units or full-pullout units, respectively.

After the force accumulator 3 has been tensioned, the ejector 5 by virtue of bearing on the entrainment element 23 is moved in the direction P1 in relation to the base plate 2 by way of the further closing movement of the drawer 53. Herein, the operational connection between the latch component 24 of the ejector 5 and the mounting pin 31 of the tension lever 30 is cancelled. This is performed by an interaction between the guide track 25 and the guide pin **24*a* on the latch component 24, wherein the latch component 24 by the guiding of the guide pin 24*a* in the guide track 25 is pivoted away from the mounting pin 31 (FIG. 8). In this state, the ejector 5 is uncoupled from the coupling installation 4 and by the entrainment element 23 is displaceable so far in the direction P1, in particular, by an automatic retracting feature, until the drawer 53 is fully closed on the basic furniture structure 51, and the ejector 5 bears on the activator 6 in the basic position according to FIG. 3**.

In the basic position of the ejector unit 1 according to FIG. 3, it is possible for a user to manually pull the drawer 53 in the opening direction M1 without an ejector function or without first cancelling the locking state, respectively. Herein, the force accumulator 3 of the ejector unit 1 is non-actuated or charged, respectively.

In order for the drawer 53 by way of the ejector unit 1 to be expelled from the position in which the drawer 53 is completely retracted or closed, respectively on the basic furniture structure 51, a user has to act on the drawer while pushing from the outside in the direction M2. To this end, the ejector unit 1 has a so-called touch-latch function which knows a locked state which is unlockable in that the drawer 53 which is closed and retracted on the basic furniture structure 51 is moved in the closing direction M2. This closing movement, or inwardly pushing of the drawer 53 in the direction M2, respectively, is performed until a stop position corresponding to a front gap which in the closed state of the drawer 53, is predefined, in particular, by way of a spacing between an internal side of the drawer front 55 and a forward end side or the side walls 56 of the basic furniture structure 51, respectively, is reached. The front gap is typically a few millimeters, for example, approx. 1 to 10 millimeters.

Accordingly, unlocking of the ejector unit 1 is adapted in such a manner that a closing movement of the drawer 53 in the direction M2 of a few millimeters, or at maximum by the value of the front gap, respectively, is sufficient for unlocking and thus for the force-assisted ejection of the drawer 53 to be reliably predefined.

Proceeding from the basic position according to FIG. 3, the ejector unit 1 together with the drawer 53 is moved in the direction M2. Since the set screw 22 bears on the entrainment element 23, the ejector 5 is moved in relation to the base plate 2 in the direction P1, a contact portion 44 on the ejector 5 thus pressing against the activator 6, accordingly pushing the latter in the direction P1. The activator 6 is present on the base plate 2 so as to be linearly displaceable in a limited manner, typically by a few millimeters or by less than the dimension of the front gap, respectively, in the directions P1 and P2.

The activator 6 is preferably directly coupled to the locking member 7 which is designed as a flap 43 in such a manner that the linear activation movement of the activator 6 in the direction P1 sets the flap 43 in rotary motion about a pivot axis D. The flap 43 by the rotating movement is released from a locking position into which the flap 43 is urged by a spring member which is configured as a leaf spring 49. In the locked state of the ejector unit 1, the flap 43 which is located in the locking position blocks the guide lever 34 or the lever attachment 40, respectively, in such a manner that the force accumulator 3 remains in the charged state thereof.

Blocking of the guide lever 34 is cancelled by the rotating movement of the flap 43. The locking element 41 on the lever attachment 40, which is biased by a leg spring 60, hereby preferably pivots out.

The locking element 41, which projects from the lever attachment 40, moves conjointly with the pivoting procedure of the guide lever 34 below the flap 43, past the latter, and continues without interruption the rotating movement of the flap 43, initiated by the activator 6, about the pivot axis D. On account thereof, a rotation angle of the flap 43 out of the locking position is advantageously enlarged. The ejector unit 1 is reliably unlocked by the movement of the lever attachment 40 below and past the flap 43 and continued by the outwardly pivoting locking element 41. To this end, a comparatively very minor linear activation movement of the activator 6 in the direction P1 is advantageously required. Subsequently, the cap 43 by the leaf spring 49 is urged back into the locking position of the former.

The locking element 41 which is present so as to be outwardly pivoted on the lever attachment 40 is again brought to bear on a front edge of the flap 43 when the force accumulator 3 is tensioned. Herein, the locking element 41 yields counter to the spring force of the leg spring 60, such that the locking element 41 is retracted so far on a periphery of the lever attachment 40 that the guide lever 34 by way of the lever attachment 40 can pivot past the flap 43.

Behind the flap 43, the locking element 41 is outwardly pivoted again by the spring force of the leg spring 60. Following the tensioning procedure, the guide lever 34 by way of the projecting locking element 41 is pushed against the flap 43 which is held by the leaf spring 49 so as to lock, the force accumulator 3 thus being in the locked state.

The rotating movement of the flap 43 of the ejector unit 1, or of the device 58, respectively, is transmitted by a synchronizer bar 61 which is disposed so as to be rotationally fixed on the flap 43 to a second device 62 which is advantageously of identical action and which is disposed on the drawer 53.

The synchronizer bar 61 advantageously connects the locking member 7 to a second locking member which is present on the second device 62. The two locking members are thus directly and/or synchronously coupled in terms of motion. This represents a synchronizing principle which is contrary to a connection between activating elements of two ejector installations on one furniture part.

LIST OF REFERENCE SIGNS

1 Ejector unit
2 Base plate
3 Force accumulator
4 Coupling installation
5 Ejector
6 Activator
7 Locking member
8 Front-gap adjustment assembly
9 Cover component
10 Helical spring
11 Helical spring
12 End
13 Fixed mounting
14 Mounting part
15 Set part
16 Operating portion
17 End
18 Motion element
19 Guide contour
20 Linear guide
21 Contact portion
22 Set screw
23 Entrainment element
24 Latch component
**24*a*** Guide pin
25 Guide track
26 Stop element
27 Guide track
29 Bearing portion
30 Tension lever
31 Mounting pin
32 Retaining member
33 Spring element
34 Guide lever
35 Connection element
36 Mounting pin
37 Mounting pin
38 Mounting pin
39 Mounting pin
40 Lever attachment
41 Locking element
42 Stop element
43 Flap
44 Contact portion
45 Housing
46 Operating portion
47 Wall portion
48 Wall
49 Leaf spring
50 Item of furniture
51 Basic furniture structure
52 Guide means
53 Drawer
54 Drawer base
55 Drawer front
56 Side wall
55 Rear drawer wall
58 Device
59 Basic structure side wall
60 Leg spring
61 Synchronizer bar
62 Device
63 Linear guide

The invention claimed is:

1. A device for moving a movable furniture part in an opening direction in relation to a basic furniture structure of an item of furniture, wherein the movable furniture part by way of guide means is capable of being put in the opening direction and in a closing direction that is counter to the opening direction, wherein the device has a force accumulator such that by way of the device which is fitted to the item of furniture the movable furniture part in the case of an opening procedure under the action of the force accumulator is capable of being put in the opening direction, wherein in the case of a movement of the movable furniture part in the closing direction a charging procedure of the force accumulator is performed, wherein the force accumulator by way of a coupling installation couples to an ejector so as to eject the movable furniture part, wherein the coupling installation comprises a lever assembly, and wherein the lever assembly is designed in such a manner that a force for the charging procedure of the force accumulator, which is introduced at the ejector, by means of the lever assembly is transmitted in a geared manner to the force accumulator.

2. The device according to claim 1, wherein the lever assembly is designed in such a manner that the force accumulator is capable of being charged by a closing procedure of the movable furniture part, wherein the charging procedure of the force accumulator in relation to the coupling installation is performed exclusively by a movement of the ejector by way of the lever assembly.

3. The device according to claim 1, further comprising a motion element, wherein the coupling installation and the ejector are mutually adapted in such a manner that during the opening procedure of the movable furniture part it is the motion element that exclusively and directly transmits a movement of the force accumulator to the ejector.

4. The device according to claim 1, wherein the lever assembly is designed in such a manner that a starting position of the movement of the ejector for the charging procedure of the force accumulator in the case of the movable furniture part being closed is variable by modifying the dimension of a single coupling member.

5. The device according to claim 1, wherein a size of the movement range of the ejector in the case of the charging procedure of the force accumulator is predefinable by the design of the lever assembly.

6. The device according to claim 1, wherein the ejector comprises a latch element, and the latch element during the charging procedure of the force accumulator couples the ejector to the coupling installation.

7. The device according to claim 1, wherein the lever assembly of the coupling installation has two coupling members, wherein a second coupling member is movably disposed on a first coupling member.

8. The device according claim 1, wherein the second coupling member of the lever assembly by way of a first end is disposed so as to be movable on the first coupling member and by way of a second end so as to be movable on the force accumulator.

9. The device according to claim 1, wherein the lever assembly has a third coupling member, and the third coupling member is movably disposed on the first coupling member.

10. The device according to claim 9, wherein the third coupling member by way of a first end is disposed so as to be movable on the second end of the first coupling member and by way of a second end so as to be movable on the ejector.

11. The device according to claim 9, wherein the third coupling member is disposed so as to be movably guided on the ejector.

12. An item of furniture having a device according to claim 1.

* * * * *